US006076664A

United States Patent [19]

Yeager

[11] Patent Number: 6,076,664

[45] Date of Patent: Jun. 20, 2000

[54] POUCH WITH PREINSERTED STRAW

[75] Inventor: James W. Yeager, Mobile, Ala.

[73] Assignee: Innoflex Incorporated, Mobile, Ala.

[21] Appl. No.: 09/299,982

[22] Filed: Apr. 27, 1999

Related U.S. Application Data

[63] Continuation of application No. 09/071,196, May 1, 1998, Pat. No. 5,937,617.

[51] Int. Cl.[7] ..... B65D 77/00; B65D 33/00

[52] U.S. Cl. ..... 206/217; 206/218; 383/209; 383/104; 229/103.1

[58] Field of Search ..... 206/217, 218; 383/104, 207, 208, 209; 229/104, 103.1

[56] References Cited

U.S. PATENT DOCUMENTS

| | | | |
|---|---|---|---|
| 3,282,411 | 11/1966 | Jardine | 229/103.1 |
| 3,380,646 | 4/1968 | Doyen et al. . | |
| 3,909,582 | 9/1975 | Bowen . | |
| 4,109,817 | 8/1978 | Payne et al. | 229/103.1 |
| 4,194,674 | 3/1980 | Pearson | 229/103.1 |
| 4,837,849 | 6/1989 | Erickson et al. . | |
| 5,148,971 | 9/1992 | Ahn . | |
| 5,482,202 | 1/1996 | Wen . | |
| 5,503,477 | 4/1996 | Schlough | 383/207 |
| 5,758,473 | 6/1998 | Patelli | 383/906 |

*Primary Examiner*—Paul T. Sewell
*Assistant Examiner*—J. Mohandesi
*Attorney, Agent, or Firm*—Rockey, Milnamow & Katz, Ltd.

[57] ABSTRACT

A pouch for holding liquids includes a pre-inserted straw within the pouch. A top end of the straw is exposed by removing a portion of the pouch. For manufacture, a web of flexible packaging material, suitable for forming a pouch or bag for storing liquids, is advanced forward in a pouch forming direction. A single straw of suitable length to fit within the confines of a resulting pouch is cut from a continuous length of straw material. The single straw is placed onto the web of packaging material in a location that will be on the inside surface of a single wall of the pouch and there it is secured in place preferably by a heat seal between one side of the straw and the inside surface of the pouch wall. The resulting pouch web material, having a plurality of straws positioned along its length provides a feedstock for forming pouches with pre-inserted straws when using a so called form and fill method of forming pouches or when making pre-made pouches. The pre-inserted straw is totally enclosed within the confines of each resultant pouch and therefore eliminates the need to be attached to the outside of the pouch or be inserted into the pouch through one of the walls of the pouch.

6 Claims, 5 Drawing Sheets

POUCH WITH PREINSERTED STRAW

This application is a continuation of Ser. No. 09/071,196, filed May 1, 1998, now U.S. Pat. No. 5,937,617.

TECHNICAL FIELD

The invention relates to disposable pouches for dispensing liquids, a bag material for making such pouches, and a method for making such bag material and pouches. Particularly, the present invention is related to stand-up pouches made with a straw pre-inserted inside the pouch, a bag material for making, and a method for making such stand-up pouches.

BACKGROUND OF THE INVENTION

Pouches, such as stand-up pouches, are well know in the art as being a convenient and a low cost means of containing and dispensing small portions of fruit juice or the like. Such juice pouches have gained acceptance among consumers even though the design has a number of inherent weaknesses. One drawback of these pouches is that the straw required to drink from the pouch is attached to the outside of the pouch and must be removed and inserted into the pouch through a wall of the pouch by the user. This is normally done by puncturing the pouch wall with the end of the straw. This procedure can be difficult because of the relatively great force required to penetrate the substrates typically used for beverage pouches. This force exerted on the outside of the pouch wall increases the internal pressure of the liquid inside the pouch causing it to spew out of the hole created when the straw finally punctures the substrate. Such procedure can result in product spillage on the body or clothing of the user.

In addition, the straw of the prior art pouches must be over-wrapped because it is exposed to contamination since it is attached to the outside of the pouch. Another disadvantage of the prior art is that the over-wrapped straw must be applied to the outside of the pouch at a subsequent step from the forming and filling of the pouch.

An even further weakness of the prior art is that the straw can become lost before being used since the straw can easily be dislodged from the outside of the pouch.

For the foregoing reasons, there is a need for a pouch formed with a straw inside that can be easily accessed through a portion of the pouch.

SUMMARY OF THE INVENTION

The present invention provides a pouch, a pouch material and a method for producing a pouch with a straw held inside the pouch and which therefore eliminates the tedious user-task of inserting the straw into the pouch by forcing it through a wall of the pouch.

The present invention eliminates the need to attach a straw to the outside of the pouch and over-wrap the straw at a subsequent step from the forming and filling of the pouch, as well as eliminates the possibility of the straw becoming contaminated or dislodged and lost before use. The straw is easily accessed from inside the pouch.

In accordance with the manufacturing method of the present invention, a web of flexible packaging material, suitable for forming a pouch or bag for storing liquids, is advanced forward in a pouch forming direction. The packaging material preferably comprises suitable film, and has a top edge, a bottom, and two substantially parallel side edges. The flexible film has an inside surface and an outside surface, with at least one of the surfaces having a portion which is heat sealable. A single straw of suitable length to fit within the confines of a resulting pouch is cut from a continuous length of straw material. The single straw is placed onto the web of packaging material in a location that will be on the inside surface of a wall of the pouch. The straw is secured in place preferably by a heat seal between one side of the straw and the inside surface of the pouch wall.

Repeating the steps described above results in the formation of a supply of pouch web material, having a plurality of transversely positioned straws along its length, which provides a feedstock for forming pouches with pre-inserted straws when using a so-called "form and fill method of forming pouches," or when making so called "pre-made pouches." The pouch with a pre-inserted straw of the present invention overcomes the disadvantages of the prior art since the straw is totally enclosed within the confines of each resultant pouch and therefore eliminates the need to be attached to the outside of the pouch or be inserted into the pouch through one of the walls of the pouch.

In addition the pouch of the present invention includes a line of weakness for easily accessing the straw inside the pouch by tearing off a header portion of the pouch into which a portion of the straw extends, but to which the straw is unattached.

Other objects, advantages and features will become more apparent with the teaching of the principles of the invention in connection with the disclosure of the preferred embodiments described in the specification, claims, and drawings.

DETAILED DESCRIPTION OF THE PREFERRED EMBODIMENTS

The detailed description of bag or pouch arrangements and methods and materials of construction described herein will be understood to be exemplary only, the specific arrangements are not to be interpreted as limiting, but rather to give support to the claims presented herein.

Figures 1, 2:
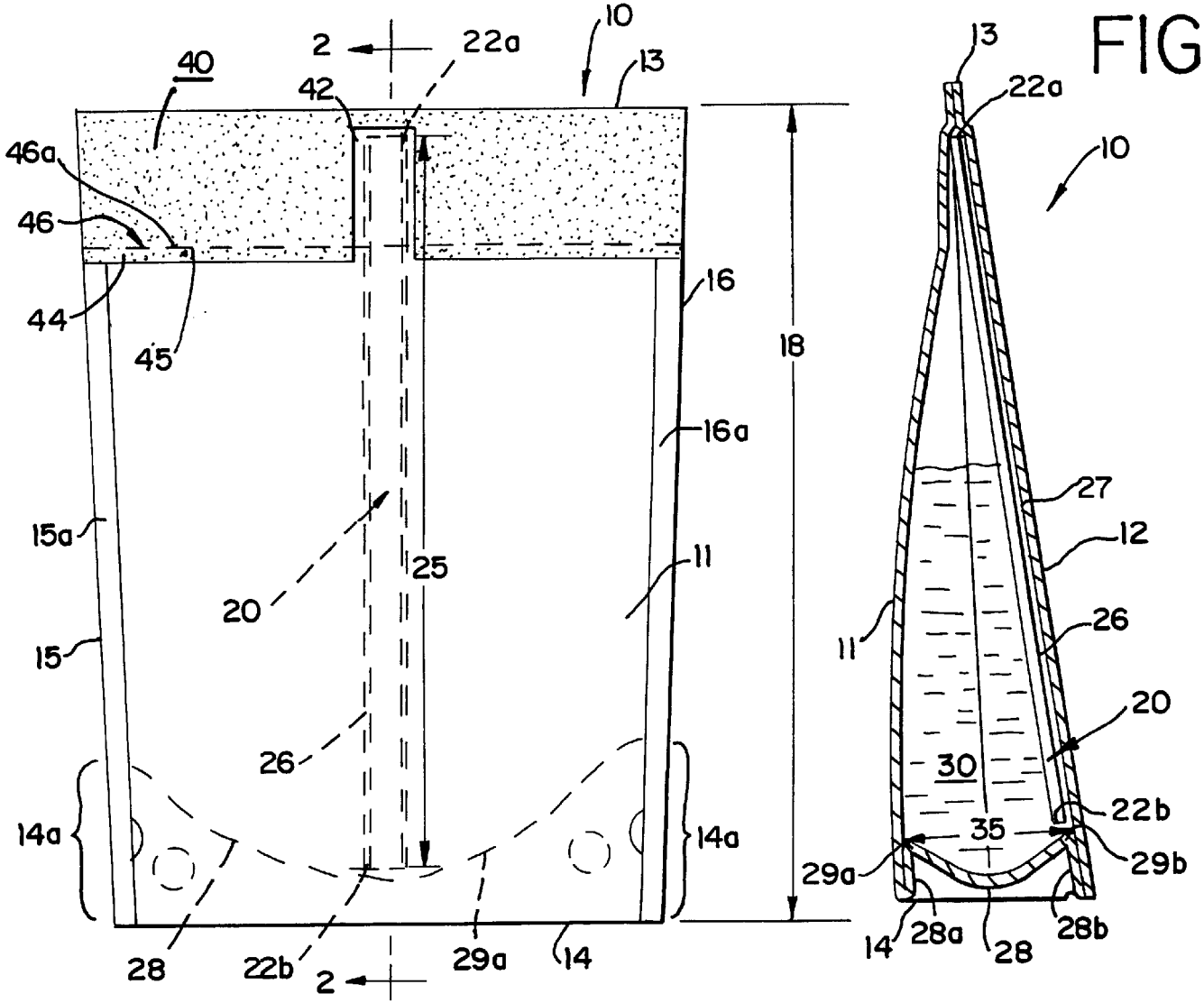
FIG. 1 is a front view of the pouch of the present invention with a straw pre-inserted inside.
FIG. 2 is a cross section view of the pouch of FIG. 1 taken along lines 2—2 of FIG. 1.
Figure 4:
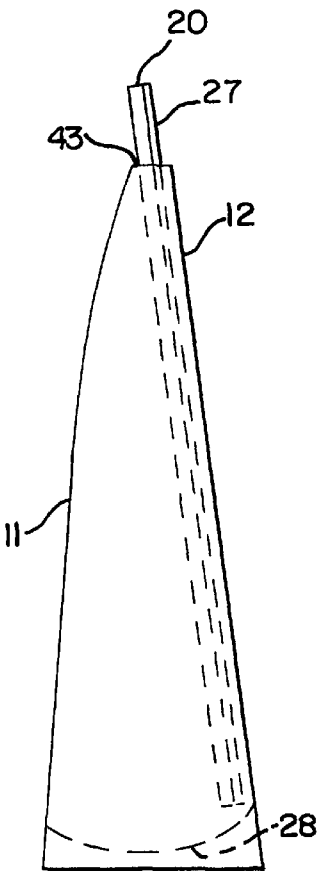
FIG. 4 is a side view of the pouch of FIG. 3.

FIGS. 1 and 2 illustrate a pouch 10 of the present invention which is well-suited for storing and dispensing liquids such as flavored beverages, drinking water, or the like. Other liquids could be stored and dispensed from the pouch as well. Pouch 10 is preferably generally rectangular including a front panel 11 and a back panel 12, with each of the front and back panels 11 and 12 having atop edge portion 13, bottom edge portion 14, and a first side edge 15 and a second side edge 16. The front panel 11 is connected to the back panel 12 along first and second continuous side seams, 15*a* and 16*a* to form a generally rectangular pouch construction, and to collectively define an interior thereof.

As shown in FIGS. 1 and 2, the bottom edge portion of the preferred embodiment of pouch 10 includes a bottom gusset panel 28. As best seen in FIG. 2, gusset panel 28 includes side panel 28*a* (which provides a first gusset portion), which is secured to the front panel 11 along a curved seal region 29*a* and a side panel 28*b* (which provides a second gusset portion) which is secured to the back panel 12 along a similar curved seal region 29*b*.

In the preferred embodiment of the pouch 10, the front panel 11 is secured to the first side panel 28*a* and the rear panel 12 is secured to the second side panel 28*b*, along at least part of a bottom edge region 14*a* of first and second side seams 15*a* and 16*a*. The first side panel 28*a* is secured to the second side panel 28*b* of the gusset panel 28 to form a four-ply construction at first and second side seams 15*a* and 16*a*, along the bottom edge regions 14*a*.

As shown in FIG. 2, the pouch 10 contains a liquid, such as liquid 30, which causes the gusset 28 to be displaced outwardly from the interior of said pouch resulting in a displacement distance 35 separating a portion of the front panel 11 away from the back panel 12, by a distance relative to the width of the gusset panel 28. This distance 35 does not exist at the side edges 15 and 16 due to the four-ply construction previously described. Due to this configuration, and the rigidity exhibited by materials from which the pouch is constructed, the pouch structure can assume an upright, "stand-up" orientation.

Therefore as shown in FIG. 2, pouch 10 is most preferably a stand-up style pouch which is most desirable for containing and dispensing a liquid 30. Such pouch arrangements, as thus far described, are well known in the art. Representative of such free standing pouches are the pouches disclosed in U.S. Pat. Nos. 3,380,646 and 4,837,849 which are hereby incorporated by reference.

Secured to preferably the center portion of back panel 12 of pouch 10 is a straw 20, although straw 20 could be positioned and secured to a portion of either the front or back panel 11 or 12 in any suitable location, such as near either of the first or second side edges 15 or 16 if desired. Straw 20 is preferably made from a thin flexible profile extruded thermoplastic material, such as polyethylene. As can best be seen in FIG. 7, the straw 20 is preferably a long thin hollow cylindrical flow tube arrangement 21 with opposing distal ends 22*a* and 22*b*. Other shapes could be used for straw 20, such as a hollow rectangular tube, provided however that liquids can be readily passed through the tube by the user.

The length 25 of straw 20 is less than the overall height 18 of pouch 10, so that the pouch 10 can totally enclose the straw 20 when straw 20 is oriented substantially perpendicular to the top edge portion 13. Although it is preferred that the straw 20 be substantially perpendicular, it is to be understood that the straw 20 could be positioned in the pouch 10 diagonally, that is, with the distal ends 22*a* and 22*b* of straw 20 substantially positioned in diagonally opposed comers of pouch 10. Preferably, the straw 20 includes an elongated flange portion 26 extending along its full length 25 between distal ends 22*a* and 22*b*, so as to provide a flattened portion 27 of increased surface area for use in securing the straw 20 to the back panel 12. Although the straw 20 only requires a portion of its length 25 to be secured to the back panel 12 of pouch 10, the straw 20 could be secured continuously along the length of the portion that permanently remains inside the unopened pouch.

Figure 7:
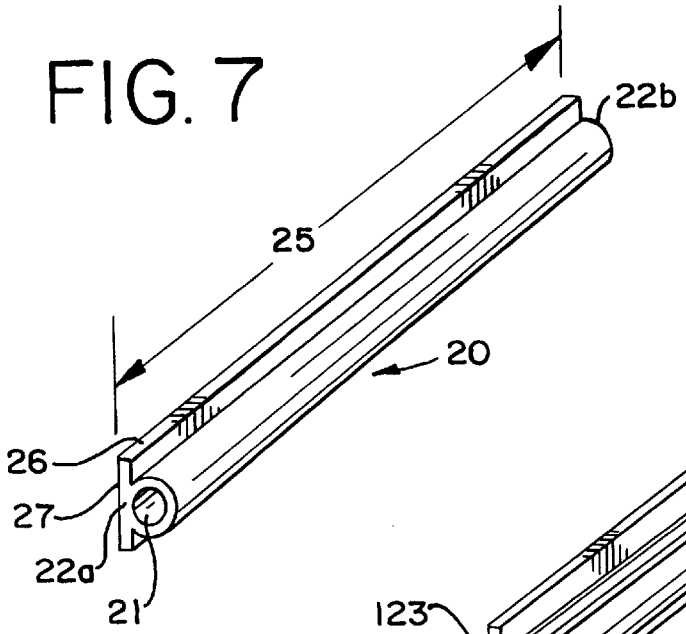
FIG. 7 is a perspective view of the straw of the present invention.
Figure 7A:
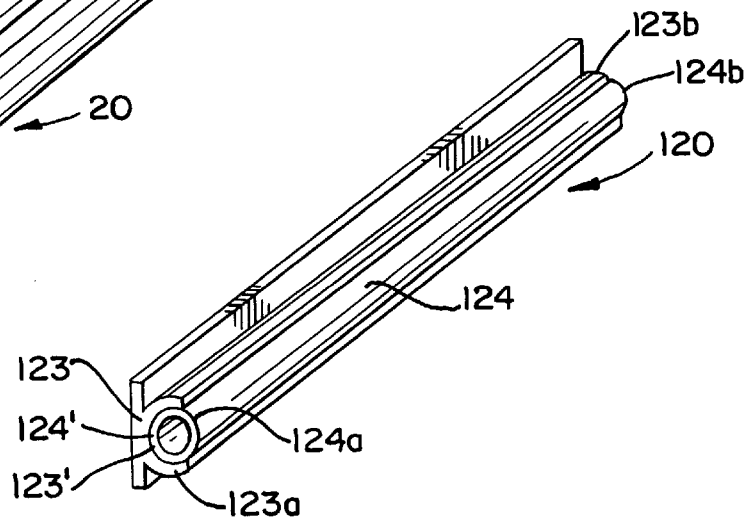
FIG. 7A is a perspective view of a second embodiment of the straw of the present invention showing the straw being formed of two separate pieces.

As shown in FIG. 7A, the straw used with the bags or pouches of the present invention could also be constructed in accordance with straw 120 comprising two separate members. A first member 123 has a groove 123' and a second member 124 has at least a portion along its length shaped in the form of a hollow flow tube 124'. The first member 123 includes grooved distal ends 123*a* and 123*b*, and the second member 124 includes tubular distal ends 124*a* and 124*b*. As shown, the tube 124' of the second member 124 nests inside the groove 123' of the first member 123, so that, the two members are slidably affixed to each other. Since the first member 123 is slidably held to the second member 124, the two pieces are free to slide axially relative to one another.

Figure 3:
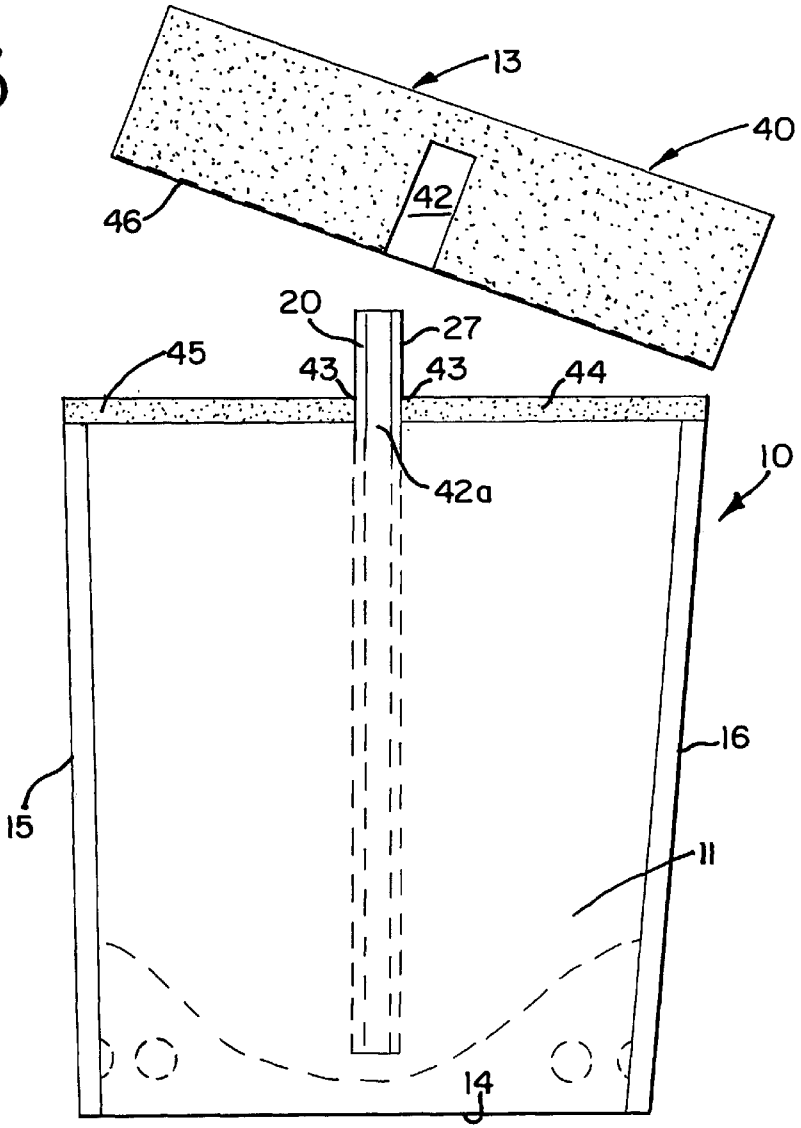
FIG. 3 is a front view of the pouch of the present invention with a perforated top header removed to access the straw.

Therefore, when the straw 120 of the present invention in FIG. 7A is attached to the panel of pouch 10 as shown in FIGS. 2 and 3, the first member 123 would be secured to the back panel 12 and the second member 124 would be free to slide up and out of pouch 10 by axially displacing the grooved distal ends 123*a* and 123*b* in relation to the tubular distal ends 124*a* and 124*b*.

This feature of the present invention allows the user of the beverage pouch 10 to slide the straw 120 partially out of the pouch 10, so as to make it easier to suck from the straw 120 when there is a sufficient amount of liquid inside pouch 10, and to slide the straw 120 back into the pouch 10 as the amount of liquid decreases, all the while maintaining contact between the straw 120 and the back panel 12.

Referring back to FIG. 1, the top edge portion 13 of pouch 10 includes a top header 40 which is comprised of a substantial portion of the front panel 11 and the back panel 12 which are laminated together. The header 40 is laminated by a securing means such as heat sealing or by the use of adhesives or by any other means known in the art. The straw 20 extends up into the header 40 of the pouch 10. A space 42 (which provides a pocket), where front panel 11 is not secured to back panel 12, is provided in the header, with straw 20 positioned therein. Also in space 42 the straw 20 is not attached to either the front panel 11 or the back panel 12. Near the lower portion of header 40 is a line of weakness 46 preferably formed from a plurality of perforations 46*a*. Line of weakness 46 could also be formed by any other method known in the art, such as laser scoring as disclosed in U.S. Pat. No. 3,909,582. U.S. Pat. No. 3,909,582 is hereby incorporated by reference.

The line of weakness 46 preferably extends completely across the width of pouch 10 from the first side edge 15 to the second side edge 16 of each of the front and back panels as shown in FIG. 1. Alternatively, the header 40 could be made to comprise only a portion of the top edge portion 13 of each panel. In such an arrangement, the line of weakness 46 would not extend all the way between the side edges 15 and 16 but would instead, at some point therebetween, extend upwardly such that one or both ends of the line of weakness 46 would terminate at the top edge portions of the front and back panels. By tearing along the line of weakness 46 it would cause only a portion of the top edge portion 13 to be removed, such as one of the top corners of the pouch 10, or a portion disposed intermediate the side edges of the pouch. In any of the contemplated configurations, the line of weakness 46 would extend generally through the space 42 so as to expose the end of the pouch straw 20 upon removal of a portion of the header 40.

As shown in FIG. 3, the header 40 can be removed from pouch 10 by tearing along the line of weakness 46 at the lower portion 44 of header 40. Part of the lower portion 44 of header 40 is below the line of weakness 46 and serves as an upper seam 45 for pouch 10, wherein the front panel 11 is secured to the back panel 12, so that pouch 10 has the ability to contain liquid 30 even after the header 40 has been removed from pouch 10.

As shown in FIGS. 1, 2, 3, and 4, the upper seam 45 need not extend across the space 42 thereby creating a vent 43 around the straw means 20 at lower section 42*a* to assist in the removal of the liquid contents of pouch 10. Vent 43 could be made smaller by extending upper seam 45 across a portion of the space 42 of pouch 10 thereby limiting the potential egress of liquid from pouch 10 through vent 43 while permitting the ingress of air into pouch 10.

Alternatively, the upper sewn 45 could be made to extend across the lower section 42*a* of space 42 thereby securing the front panel 11 to the back panel 12, and the front panel 11 and the back panel 12 to both sides of straw 20, so as to prevent air or liquids from entering or leaving the pouch around straw 20 at the point where straw 20 protrudes from the lower portion 44 of header 40 after header 40 has been removed.

Figures 5, 5A:
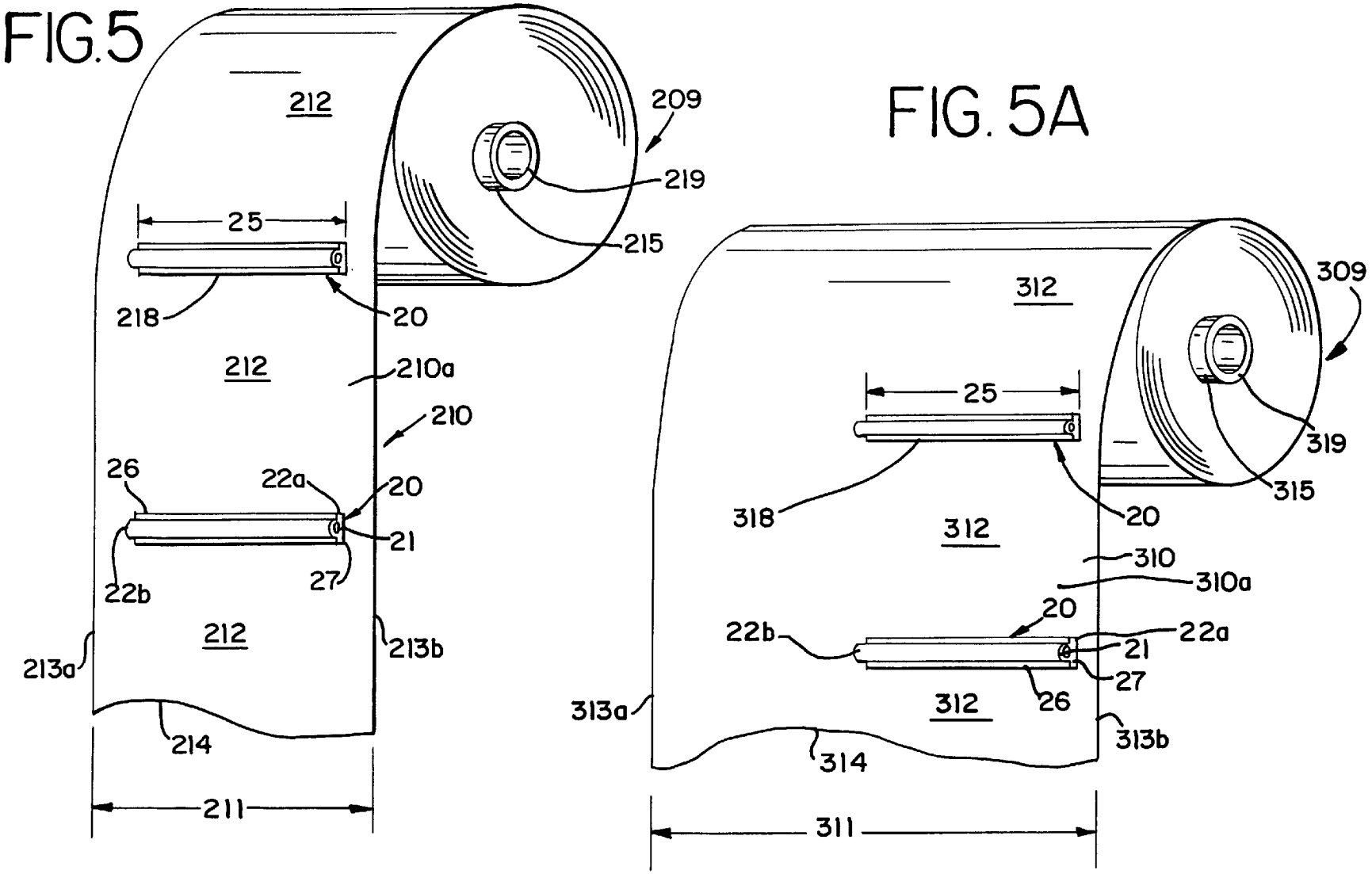
FIG. 5 is a perspective view of a roll of film with straws pre-applied for making the back wall of the pouch of the present invention.
FIG. 5A is a perspective view of a roll of film with straws pre-applied for making the pouch of the present invention.

Referring now to FIG. 5, there is shown a roll of film material 209 for making the bags or pouches 10 of the present invention, comprising a bag material 210 preferably comprising a plurality of substantially transversely positioned thin flexible straws 20 secured to the surface 210*a* of bag material 210. Bag material 210 has two substantially parallel side edges 213*a* and 213*b* and a top end 214 and a bottom end 215. By "transversely positioned" it is meant that the length 25 of straw 20 is oriented perpendicularly to the films edges 213*a* and 213*b*. The bottom end 215 is shown in FIG. 5 to be wrapped around a core tube 219.

Figure 8:
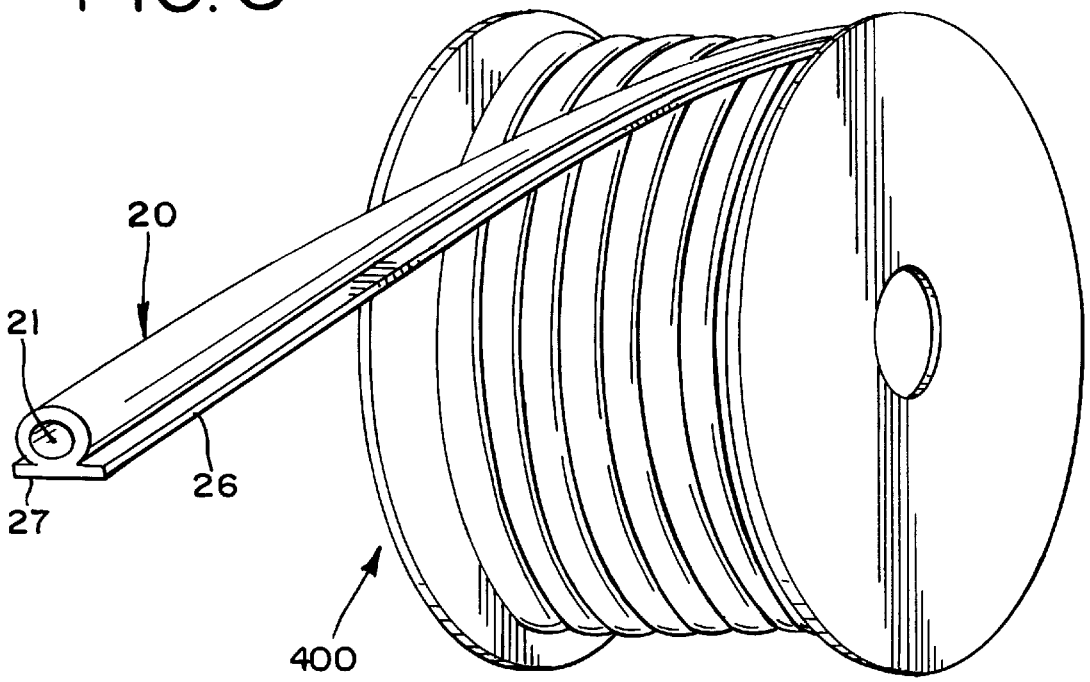
FIG. 8 is a perspective view of the straw material of FIG. 7 shown in continuous form and wound onto a spool.

Shown in FIG. 5, but best seen in FIG. 7, is flexible straw 20 being generally cylindrical with a hollow interior 21 with opposing distal ends 22*a* and 22*b*. Each flexible straw 20 is preferably cut from a spool of continuous straw material 400, as shown in FIG. 8, to a length 25 less than the width 211 of bag material 210. Preferably, straw 20 includes an elongated flange portion 26 extending along its full length 25 between distal ends 22*a* and 22*b*. The flattened flange portion 27 of the elongated portion 26 is secured to bag material 210 at a connection 218 that is preferably made by heat sealing the bag material 210 to the flexible straw 20, but any method known in the art for connecting packaging materials could be utilized, such as the use of adhesives. The locations of the straws 20 correspond to the locations of the inside surfaces of the back panels 212 of the bags to be formed from bag material 210.

Referring now to FIG. 5A, there is shown a roll of film material 309 which is an alternate embodiment of the roll of film for making the bags or pouches of the present invention comprising a bag material 310 containing a plurality of preferably transversely positioned thin flexible straws 20 secured to the surface 310*a* of bag material 310. Bag material 310 has two substantially parallel side edges 313*a* and 313*b* and a top end 314 and bottom end 315. By "transversely positioned" it is meant that the length 25 of straw 20 is oriented perpendicularly to the films edges 313*a* and 313*b*.

Preferably, straw 20 includes an elongated flange portion 26 extending along its full length 25 between distal ends 22*a* and 22*b*. Flexible straw 20 has a length 25 less than half the width 311 of bag material 310. The flattened portion 27 of the elongated flange portion 26 is secured to bag material 310 at a connection 318 that is preferable made by heat sealing the bag material 310 to the flexible straw 20, but any method known in the art for connecting packaging materials could be utilized such as the use of adhesives. The locations of the straws 20 correspond to the locations of the inside surfaces of the back panels 312 of the bags to be formed from bag material 310.

It should be understood that other forms of storing film 210 and 310 well known in the art, such as fan-folding into a stack, are considered to be within the purview of the present invention.

The straws secured to the rolls of film 210 and 310 of the present invention could be constructed in accordance with straw 120 as shown in FIG. 7A, comprising two separate members, a first member 123 having a groove 123' and a second member 124, having at least a portion along its length shaped in the form of a tube 124'. The first member 123 includes grooved distal ends 123*a* and 123*b*, and the second member includes tubular distal ends 124*a* and 124*b*. As shown, the tube 124' of the second member 124 nests inside the groove 123' of the first member 123, so that the two members are slidably affixed to each other. The two pieces are thus free to slide axially relative to one another.

Figure 6:
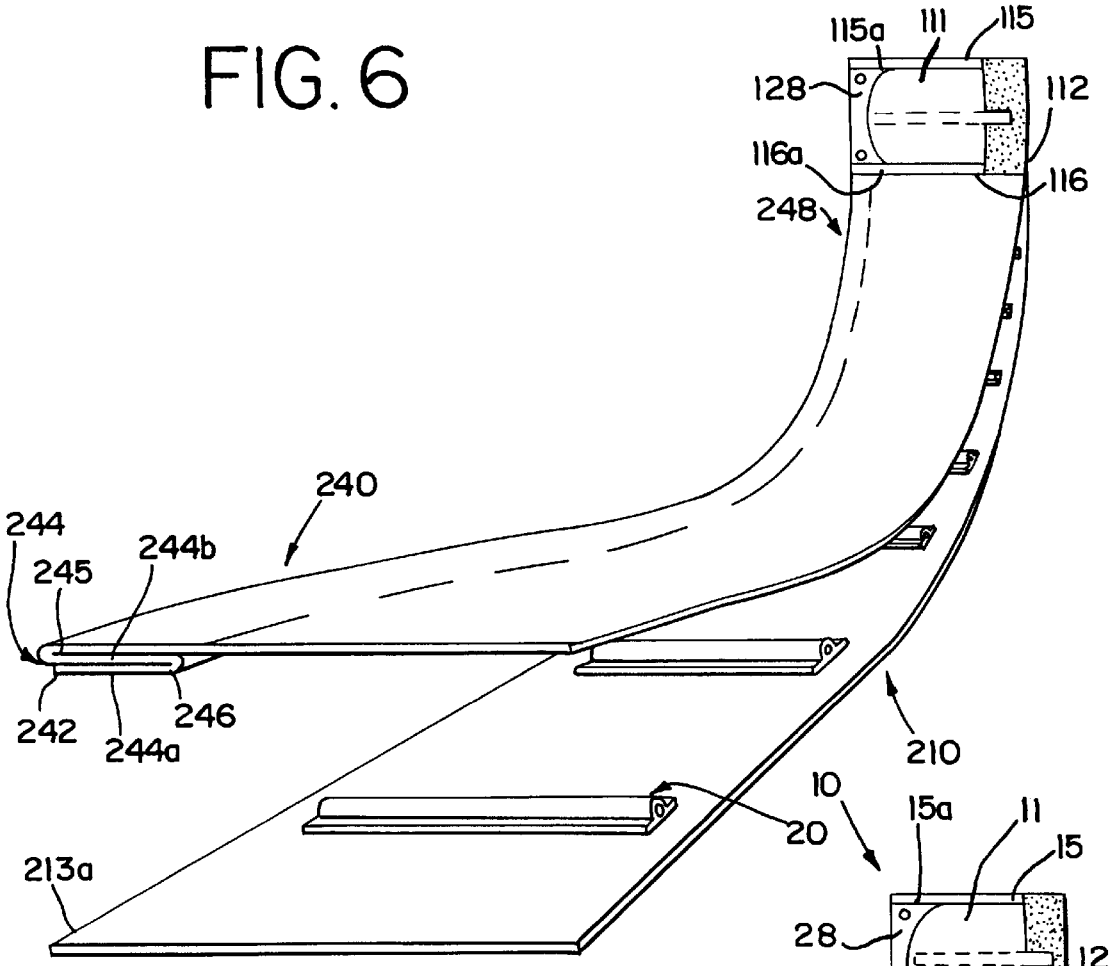
FIG. 6 is a perspective view which shows the method of making the pouch of the present invention from the back panel film with pre-applied straws of FIG. 5.

Now referring to FIG. 6, there is shown the method of forming a bag or pouch with a pre-inserted straw from the material of FIG. 5. A first web 210 of bag material with straws 20 attached is brought together in opposition with a second web 240 of bag material to ultimately form opposing bag panels of the resulting bags to be formed. As shown, a portion of the second web 240 is folded along its length near one of its longitudinal edges 242 at a first longitudinal seam 245 and at a second longitudinal seam 246, to form a bottom gusset panel 244 comprising a first side panel 244*a* and a second side panel 244*b*.

The bottom gusset panel 244 could be formed from a third web of bag material instead of folding a portion of the second web 240 of bag material, if so desired, and the first longitudinal seam 245 would be formed from a connection at the fold between the second and third webs, instead of by an integral fold in the second web 240.

With further reference to FIG. 6, in a latter step of the method, the first web 210 and second web 240 are cut and trimmed along side edges 213*a* and 242 if needed, and longitudinally sealed together as generally indicated at 248. The first web 210 is secured to the first side panel 244*a* and the second web 240 is secured to the second side panel 244*b*, preferably by heat sealing. To finish forming a bag, such as pouch 10, the first web 210 is connected to the second web 240 and the first web 210 is secured to the first side panel 244*a* and the second web 240 is secured to the second side panel 244*b* along first and second continuous transverse side seams, 115*a* and 116*a* respectively, preferably by heat sealing, to form a pouch with a front panel 111, a back panel 112, and a gusset panel 128. Lastly, a single pouch is separated from the web arrangement when a first side edge 115 and a second side edge 116 are formed by transversely shear cutting between successive pouches.

Figure 6A:
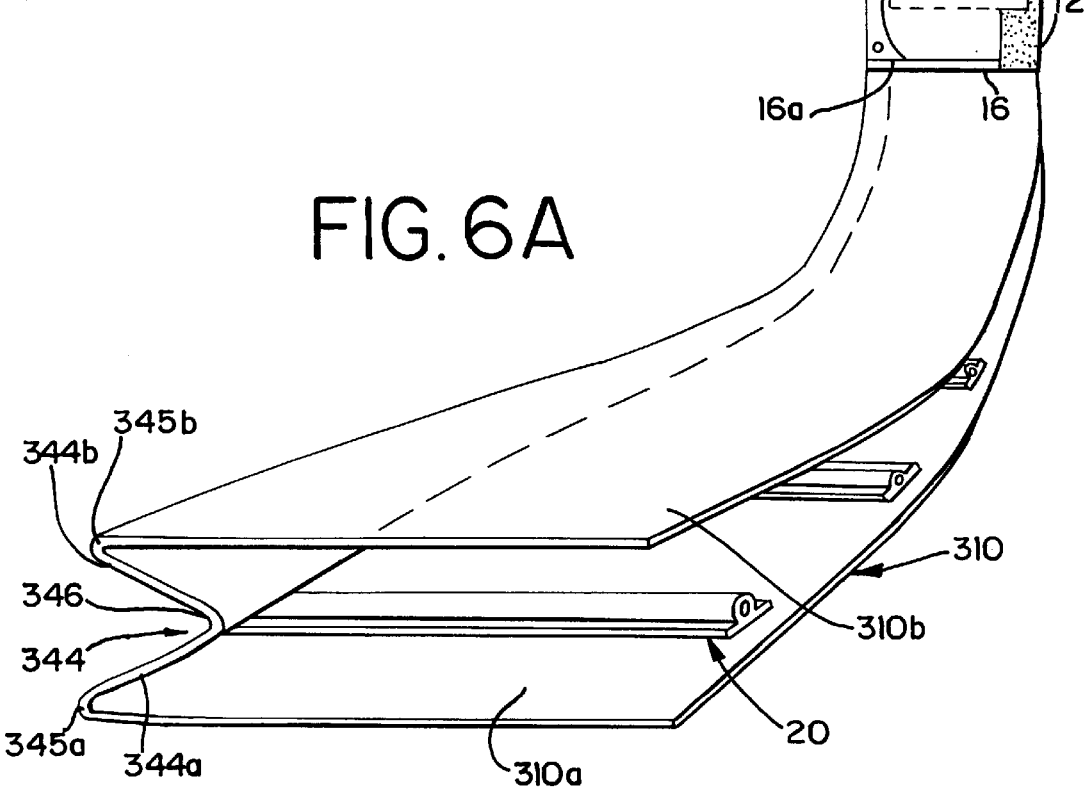
FIG. 6A is a perspective view which shows the method of making the pouch of the present invention from the film with preapplied straws of FIG. 5A.

As is well know in the art, it may be desirable to form pouches from a single roll of web of material. By providing a single primary web material 310 with straws 20 attached offset relative to the web axis as shown in FIG. 5A, pouches of the present invention can be formed from a single web. As can been seen in FIG. 6A, a gusset panel 344 is formed by creating a center seam 346 at, or near the longitudinal center of primary web 310 to define first and second continuous longitudinal panels 310*a* and 310*b*, and by tucking the center seam 346 inward between the first and second longitudinal panels 310*a* and 310*b* while folding them together. The gusset panel 344 has a first gusset portion or side panel 344*a*, formed between the center seam 346 and a first seam 345*a*, and has a second gusset portion or side panel 344*b*, formed between the center seam 346 and a second seam 345*b*. To finish forming a bag, such as pouch 10, the first longitudinal panel 310*a* is connected to the second longitudinal panel 310*b*, the first longitudinal panel 310*a* is secured to the first side panel 344*a*, and the second longitudinal panel 310*b* is secured to the second side panel 344*b* along first and second continuous transverse side seams, 15*a* and 16*a* respectively, preferably by heat sealing, to form a pouch with a front panel 11, a back panel 12, and a gusset panel 28. Lastly, a single pouch is separated from the web arrangement when a first side edge 15 and a second side edge 16 are formed by transversely shear cutting between successive pouches.

It should be understood that it is within the purview of the present invention to form bags of the pre-made style or of the form, fill, and seal style. In a so called form, fill, and seal method of making pouches or bags, as is well known in the art, the product to be stored is filled into the pouch prior to the transversely shear cutting between successive pouches. In a form, fill, and seal method of making pouches of the present invention, the top header 40, comprising the open space 42 for loosely enclosing the top distal end 22*a* of straw 20, and the line of weakness 46, are formed in pouch 10 after the filling step and prior to the transversely shear cutting between successive pouches.

The forming of pre-made pouches of the type shown in FIG. 1, where the pouch 10 does not yet include the header 40 even after the transversely shear cutting between successive pouches occurs, is also within the purview of the present invention. As is well know in the art, in the forming of pre-made pouches, each pouch is made complete with the exception that the top seal of the pouch is open and is later sealed shut after the subsequent off-line filling step. In the forming of a pre-made pouch of one method of the present invention, the header 40, comprising the open space 42 for loosely enclosing the top distal end 22*a* of the straw 20 along with the line of weakness 46, is not produced in the finished pouch during the bag making process, but instead, at a later step after the bag has been filled during an off-line filling step. By "off-line" it is meant that the filling step is not part of the line of bag making equipment used to produce the pouch as in the so called form, fill, and seal process.

In either the form, fill, and seal process or the process of making pre-made bags, the pouches or bags 10 of the present invention could be produced by processing or machining the rolls of film 210 or 310 including pre-applied straws 20 or 120, using a so called conventional bag making process of either type. It should be understood that it is within the purview of the method of my invention to include the cutting of straws 20 or 120 from a continuous spool of straw material 400 and positioning and securing the straws 20 or 120 to a web of material in-line with the process required, as previously described, for producing bag film with pre-applied straws or either pre-made or form, fill, and seal style bags or pouches.

Examples of in-line equipment which can be modified to attach straws to a web of bag making material are U.S. Pat. No. 4,655,862 and U.S. Ser. No. 08/896,179 filed Jul. 17, 1997. In these disclosures the arrangements for applying individual zippers to webs can be adapted to apply individual straws to film. The straws can be supplied in a continuous, elongate supply such as in a coil and cut and placed on the web as are the zippers in U.S. Ser. No. 08/896,179 filed Jul. 17, 1997. The ends of the straws would not however be crushed. These disclosures are incorporated by reference.

It is also within the purview of the present invention to form two bags such as pouch 10, simultaneously, in a head-to-head fashion. By "head-to-head" it is meant that the pouches are formed joined together at a common point at their open ends and during a later cutting and trimming step are cut apart.

The bags and film of the invention are constructed from plastic film well known in the art. Preferably, the films and bags of the invention are constructed from heat sealable flexible film structures that include materials such as polyethylene, polypropylene, nylon, ethylene vinyl acetate, ethylene vinyl alcohol, foil and paper laminates, or combinations thereof and the like. A particularly preferred flexible film is metalized foil laminated to polyethylene.

Although the preferred embodiments of the invention have been described in detail above, it should be understood that the invention is in no sense limited thereby, and its scope is to be determined by that of the following claims.

What is claimed is:

1. A stand-up pouch for storing and dispensing liquids, comprising:

(a) front and back panels each having a top edge portion, a bottom edge portion, a first side edge, and a second side edge, said front panel being connected to said back panel along a continuous first side seam and a continuous second side seam, to form a generally rectangular pouch construction whereby said panels and said side seams define an interior;

(b) a bottom gusset panel, having a first side panel and a second side panel, said first side panel being secured to said front panel along a first curved line near said bottom edge portion thereof, and said second side panel being secured to said back panel along a second curved line near said bottom edge portion thereof, wherein on at least part of a bottom edge portion of each of said first and second side seams, in the regions where said first side panel is secured to said front panel, and said second side panel is secured to said back panel, said first side panel is secured to said second side panel of said gusset panel to form a four-ply construction at said first and second side edges, said gusset panel being displaced outwardly from said interior of said pouch when said pouch is filled with said liquid thereby forcing said front panel away from said back panel except at said side seams resulting in the formation of a rigid base construction for supporting said pouch arrangement in a standing orientation;

(c) a drinking straw, comprising a thin, flexible, hollow flow tube with opposing distal ends, having a length less than the height of said pouch, and being secured to a portion of one of said panels of said pouch whereby one of said distal ends of said straw is positioned in a region at which said gusset panel is outwardly displaced;

(d) a top header, being formed by securing a portion of said front panel to said back panel in an area occupying at least a part of a top edge portion of said pouch and surrounding said straw, said header being unattached to said straw and having a transversely extending line of weakness, whereby a portion of said top header can be easily removed from said pouch, by tearing along said line of weakness, and thereby exposing one of said distal ends of said straw to facilitate drinking said liquid through, (e) wherein said top header includes an upper bag seam below said line of weakness for containing said liquids inside said pouch, whereby said front panel is attached to said back panel except at a portion adjacent said straw, said portion adjacent to said straw providing a vent for said pouch to assist in the removal of the liquid contents of said pouch, said upper seam being provided for substantially containing said liquid in said pouch even after the portion of said header surrounding said straw has been removed from said pouch to expose said distal end of said straw.

2. The article of claim 1 wherein said straw further includes a flange means for assisting in the securing of said straw to said pouch.

3. The article of claim 1 wherein said straw further comprises a second member having a groove along at least a portion of its length matching said tube, whereby said tube nests inside said groove, and said tube of said straw being loosely affixed to said second member, whereby the two pieces are free to slide axially relative to one another.

4. The article of claim 1 wherein said straw extends beyond said upper seam.

5. The article of claim 1 wherein said line of weakness comprises a line of perforations.

6. The article of claim 1 wherein said line of weakness comprises a laser score line.

* * * * *